US005606333A

United States Patent [19]

Hannan

[11] Patent Number: 5,606,333

[45] Date of Patent: Feb. 25, 1997

[54] LOW WIND RESISTANCE ANTENNAS USING CYLINDRICAL RADIATING AND REFLECTOR UNITS

[75] Inventor: Peter W. Hannan, Smithtown, N.Y.

[73] Assignee: Hazeltine Corporation, Greenlawn, N.Y.

[21] Appl. No.: 390,735

[22] Filed: Feb. 17, 1995

[51] Int. Cl.[6] ..... H01Q 21/12

[52] U.S. Cl. ..... 343/813; 343/700 MS; 343/815; 343/817; 343/872

[58] Field of Search ..... 343/812, 813, 343/814, 815, 820, 821, 872, 873, 700 MS; H01Q 21/12

[56] References Cited

U.S. PATENT DOCUMENTS

| | | | |
|---|---|---|---|
| 2,558,727 | 7/1942 | Bernet | 343/813 |
| 3,300,784 | 1/1967 | Ervine | 343/812 |
| 3,470,560 | 9/1969 | Fray | 343/815 |
| 3,564,551 | 1/1970 | Mills et al. | 343/812 |
| 3,836,977 | 9/1974 | Wheeler | 343/815 |
| 4,516,132 | 5/1985 | Bond et al. | 343/815 |
| 5,111,214 | 5/1992 | Kumpfbeck et al. | 343/815 |
| 5,285,211 | 2/1994 | Herper et al. | 343/791 |
| 5,339,089 | 8/1994 | Dienes | 343/700 MS |
| 5,363,115 | 11/1994 | Lipkin et al. | 343/872 |

FOREIGN PATENT DOCUMENTS

| | | | |
|---|---|---|---|
| 2142475 | 1/1985 | United Kingdom | 343/700 MS |

OTHER PUBLICATIONS

Wheeler, H. A., "A Vertical Antenna Made of Transposed Sections of Coaxial Line", pp. 160–164, *IRE Convention Record*, vol. 4, Part 1, 1956 no month.

*Primary Examiner*—Donald T. Hajec
*Assistant Examiner*—Tan Ho
*Attorney, Agent, or Firm*—E. A. Onders; K. P. Robinson

[57] ABSTRACT

Multi-beam antennas with relatively large effective apertures for high antenna gain are provided for tower or pole mounting for cellular and other uses. Low wind resistance is achieved by use of thin cylindrical radiating units and thin cylindrical tuned reflector units. Each radiating unit includes separately excited upper and lower radiators, each including a microstrip pattern of a phase reversed series of half-wave transmission line sections on a substrate enclosed in a fiberglass tube radome. Each tuned reflector unit includes a resonant stack of electrically isolated metal rods enclosed in a fiberglass radome. In one embodiment, four cylindrical radiating units, each including upper and lower radiators, are laterally spaced in front of upper and lower reflector configurations, each including seven laterally spaced tuned reflector units. Four beams are provided by a beam forming network arranged to couple antenna element signal feeds to the four upper radiators and corresponding reverse phase signal feeds to the four lower radiators.

23 Claims, 3 Drawing Sheets

LOW WIND RESISTANCE ANTENNAS USING CYLINDRICAL RADIATING AND REFLECTOR UNITS

This invention relates to low wind resistance antennas and, more particularly, to such antennas providing higher gain multi-beam capabilities suitable for tower mounting for cellular communication system applications.

BACKGROUND OF THE INVENTION

In cellular communication systems, antenna installations are provided at separated locations to enable communication with mobile system users within a surrounding cell area. As cellular use and installations increase it has become apparent that cost savings or improved performance, or both, could be provided through availability of improved antennas and antenna systems. A common type of cell antenna installation utilizes three 120 degree single beam sector antennas, to provide 360 degree azimuth coverage. Antenna systems suitable for providing coverage of a 120 degree sector with improvements in antenna gain, coverage area and other operational aspects are described in copending U.S. patent application Ser. No. 08/379,820, titled "High Gain Antenna Systems for Cellular Use", filed Jan. 27, 1995, and assigned to the same assignee as the present invention. The systems described therein include provision for use of multiple beam antennas for providing coverage of each such 120 degree sector of a cell.

However, many cell antenna installations rely on antennas mounted on towers or poles in order to achieve desired coverage. Such towers and poles are typically designed and constructed with finite limits on safe levels of loading under high wind conditions, in order to avoid structural failure. Use of a multi-beam antenna in such installations may typically necessitate an antenna having a larger size, as compared to a single beam 120 degree sector antenna designed for the same frequency band of operation. As a result, the objective and benefits of employing multi-beam antennas in such tower installations may not be achievable where high wind loading of a larger antenna would potentially exceed the applicable wind load limit.

It is therefore an object of the present invention to provide antennas having one or more of the following characteristics:

—low wind loading by use of thin cylindrical radiating and reflector units;

—multi-beam or higher gain capabilities, or both, with low wind loading;

—improved radiator construction using a simple microstrip substrate enclosed in a dielectric tube;

—improved tuned reflector construction using thin aluminum rod sections in a dielectric tube;

—beam forming network dual phase coupling to upper and lower radiators;

—low component count of accurately reproducible electrical components for performance and cost benefits; and —improved operating capabilities for cellular and other applications.

SUMMARY OF THE INVENTION

In accordance with the invention, an antenna with thin cylindrical radiating and reflector units for low wind resistance includes a plurality of cylindrical radiating units laterally spaced relative to a forward direction and each having upper and lower radiators. Each of such radiators includes a linear series of nominally one-half wavelength transmission line sections extending in a vertical direction with gaps between the sections and arranged to be fed in series from one end. In a preferred embodiment such radiators have the form of microstrip line sections on an insulative substrate enclosed in a thin cylindrical radome. As to each radiating unit, the upper and lower radiators are respectively positioned above and below an intermediate level with each upper radiator configured for lower end excitation feed and each lower radiator configured for upper end excitation feed.

A beam forming network is coupled to the lower end of the upper radiator of each radiating unit and to the upper end of the lower radiator of each radiating unit to provide a predetermined beam pattern. Such a beam pattern may typically include four beams which collectively provide coverage in a 120 degree azimuth sector. In a preferred embodiment the beam forming network is configured to provide dual polarity outputs via balun connections.

The antenna also includes a plurality of laterally spaced cylindrical tuned reflector units positioned behind the radiating units. Each tuned reflector unit includes a plurality of conductive segments extending in electrically isolated end-to-end relationship in a vertical direction. In a preferred embodiment each tuned reflector unit has the form of self resonant segments of aluminum rod isolated by intermediate insulative discs and enclosed within a cylindrical radome. A support assembly is configured to support the radiating units in laterally spaced arrangement and the tuned reflector units in laterally spaced arrangement behind the radiating units.

For a better understanding of the invention, together with other and further objects, reference is made to the accompanying drawings and the scope of the invention will be pointed out in the accompanying claims.

DESCRIPTION OF THE INVENTION

Figure 1:
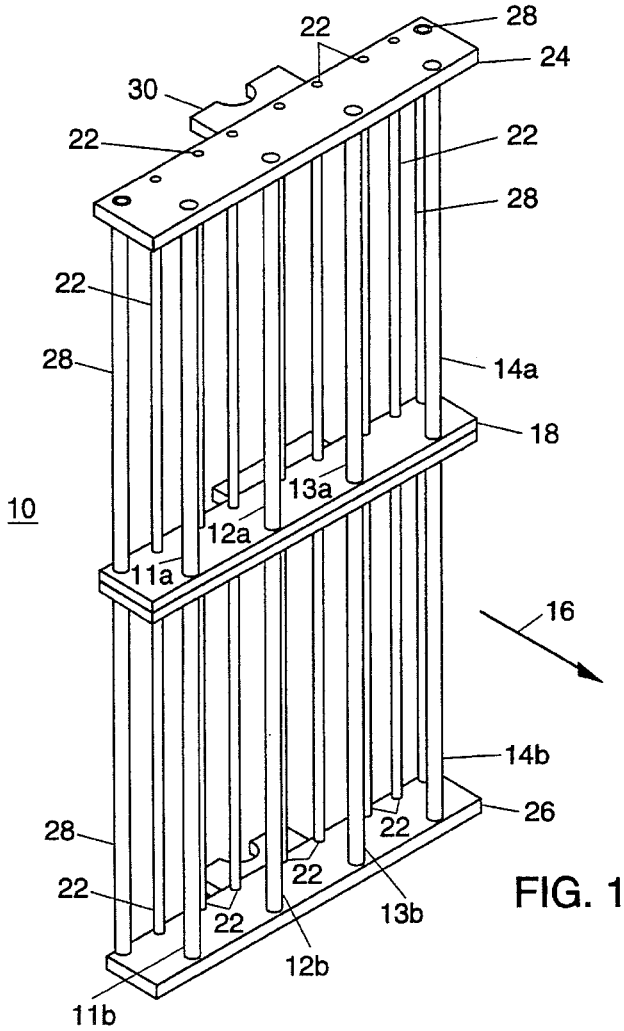
FIG. 1 is an orthogonal view of a multi-beam low wind resistance antenna in accordance with the invention.

A low wind resistance multi-beam antenna 10 in accordance with the invention is shown in orthogonal view in FIG. 1. The illustrated antenna is configured to provide four beams covering a desired azimuth sector with pole mounting for cellular communication and other applications. By way of reference, an antenna of the type shown having principal height and width dimensions of 66 inches by 30 inches for use within a band from 800 to 850 MHz, had an effective flat plate wind loading area of less than 3.1 square feet. This compares to 13.75 square feet for an antenna having a flat solid configuration of the same size. It also compares to wind loading areas between these two values for antennas using prior types of metal mesh and other reflector surfaces including openings of different forms. A significant reduction in wind loading is thus provided.

As shown in FIG. 1, the multi-beam array antenna 10 includes a plurality of vertically positioned radiating units 11*a*/11*b*, 12*a*/12*b*, 13*a*/13*b* and 14*a*/14*b*. Each such radiating unit includes an upper radiator (i.e., 11*a*) and a lower radiator (i.e., 11*b*) having a form of construction which will be further described with reference to FIG. 2. As shown the radiating units are laterally spaced relative to forward direction 16.

The upper and lower radiators 11*a* and 11*b* of radiating unit 11*a*/11*b*, and of each of the other radiating units, are respectively positioned above and below an intermediate level, represented in FIG. 1 by housing 18. As will be further described, each upper radiator 11*a*, 12*a*, 13*a* and 14*a* is configured for lower end excitation feed and each lower radiator 11*b*, 12*b*, 13*b* and 14*b* is configured for upper end excitation feed. The antenna also includes a beam forming network 20 which, in this configuration, is enclosed within housing 18 as will be discussed with reference to FIG. 5 (which is an opened view of the lower section of housing 18). The beam forming network is coupled to the lower end of each of the upper radiators 11*a*, 12*a*, 13*a* and 14*a* and to the upper end of the lower radiators 11*b*, 12*b*, 13*b* and 14*b* of each of the radiating units. Beam forming network 20 may be a known form of Butler network which, for signal transmission, includes four beam signal input ports and four antenna outputs suitable for connection to upper radiators 11*a*, 12*a* 13*a* and 14*a*, for example. In order to feed both the four upper radiators and the four lower radiators 11*b*, 12*b*, 13*b* and 14*b*, the four signal outputs are each connected to a separate balun providing two opposite phase outputs from each signal output. The respective outputs of each balun are coupled to the upper and lower radiators of one of the radiating units. This provides same phase excitation of the upper and lower radiators of a particular radiating unit as a result of the opposite end excitation connections. It will be appreciated that the antenna has reciprocal properties and in practice may be utilized for signal reception, signal transmission, or both on a shared basis. In other embodiments other suitable types of networks or devices may be substituted for the Butler network and baluns referred The antenna of FIG. 1 further includes a plurality of laterally spaced tuned reflector units 22. Seven of these tuned reflector units are shown positioned in a row behind the upper radiators of the four radiating units and seven more are shown positioned in a row behind the lower radiators. The construction and characteristics of the tuned reflector units 22 will be described further with reference to FIG. 3. It is noted that some of the tuned reflector units are partially obscured in the FIG. 1 view by the somewhat larger diameter radiating units.

As illustrated, the antenna has a support assembly configured to support the radiating units in a laterally spaced arrangement and the tuned reflector units in a laterally spaced arrangement behind the radiating units. In FIG. 1 the support assembly comprises the following elements. Upper transverse structural unit 24 is fastened to the upper ends of each upper radiator and each upper tuned reflector unit. Lower transverse structural unit 26 is fastened to the lower ends of each lower radiator and lower tuned reflector unit. The intermediate ends of all of the radiators and tuned reflector units are fastened to intermediate housing 18, as shown. For greater structural stability upper and lower cylindrical support members 28 are provided at each side of the antenna fastened between the respective upper and lower structural units 24 and 26 and housing 18. While a variety of structural arrangements may be provided in different applications, in a currently preferred embodiment structural units 24 and 26 are machined or cast aluminum with provision for positioning and bolting in place fixtures at ends of the radiators, tuned reflector units and cylindrical support members. Structural units 24 and 26 are also configured to support rear mounting of antenna mounting brackets 30 which may be configured for mounting the antenna on a tower, pole or other structure. Housing 18 is an aluminum housing designed to: enclose the beam forming network and associated baluns and transmission line sections; support downward aligned beam signal input/output connectors such as N-type connectors; structurally connect to the intermediate ends of the radiators, tuned reflector units and cylindrical support members; and optionally also structurally support a rear antenna mounting bracket similar to mounting brackets 30 attached to the rear of units 24 and 26. In a currently preferred embodiment of the antenna the support assembly is designed so that the upper radiators 11*a*, 12*a*, 13*a* and 14*a* are laterally offset slightly so as not to be positioned directly above the lower radiators 11*b*, 12, 13*b* and 14*b*. This facilitates electrical connections between the radiators and the beam forming network.

Figure 2B:
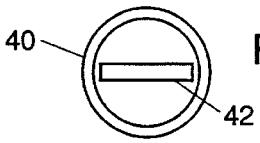
FIGS. 2 and 2A show elements of radiators used in the FIG. 1 antenna and FIG. 2B is a top view of such a radiator.
Figure 2:
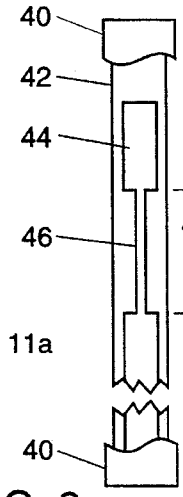
Figure 2A:
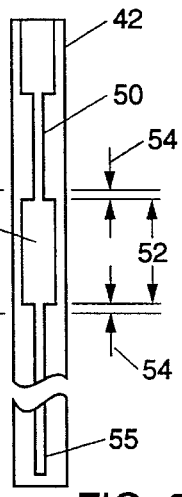

Referring now to FIGS. 2 and 2A, there are illustrated features of a radiator, such as radiator 11*a* of radiating unit 11*a*/11*b* of the FIG. 1 antenna. As shown, radiator 11*a* includes a cylindrical radome type tube 40 of radiation transmissive material, such as fiberglass. The middle portion of tube 40 has been removed to make visible an elongated rectangular planar insulative substrate 42 positioned within tube 40. As shown in the enlarged end view in FIG. 2B, the substrate 42 may be slightly narrower than the inner diameter of tube 40 to enable substrate 42 to be inserted and thereafter loosely constrained and held in position by tube 40. The word "cylindrical" is used in its geometric sense defining a circular or any other cross-sectional form, such as an oval, hexagon, etc., which may be formed by a straight line moving parallel to a fixed axis.

FIGS. 2 and 2A show opposite sides of substrate 42 and conductive patterns formed thereon. FIGS. 2 and 2A may be considered to respectively show the back and front of substrate 42. The back pattern of FIG. 2 includes an interconnected pattern of wide ground plane sections 44 and thinner line sections 46 and the front pattern of FIG. 2A includes an interconnected pattern of wide sections 48 and line sections 50. Considering the back and front patterns as superimposed on opposed sides of the substrate 42, these patterns form a series of microstrip transmission line sections of alternating forward and back orientation. The thinner sections 46 and 50 represent nominally one-half wavelength sections of microstrip line at a frequency associated with a desired operating frequency band (i.e., the effective electrical length of sections 46 and 50 is nominally one-half wavelength). The associated wide sections 44 and 48 have a physical length 52 of one-half wavelength or less in this configuration. As shown, the dimensioning is such that gaps 54 exist between the successive reversed orientation transmission line sections. For present purposes "nominally" is defined as encompassing values within about plus or minus thirty percent of a stated value or dimension. It will be seen that in the FIG. 1 antenna, each radiator includes a linear series of nominally one-half wavelength transmission line sections extending in a vertical direction. The term "vertical direction" is defined as a direction along a line extending principally vertically, i.e., at an angle to the horizontal of a least 45 degrees. For optimum coverage in communications applications the beam may be tilted downward a few degrees by mounting the antenna in a physically tilted alignment. Although tilted, the antenna would still be considered to be aligned in a vertical direction.

The radiator shown in FIGS. 2 and 2A is configured for lower end excitation from an output of the beam forming network 20 referred to above and may additionally include an impedance transformation arrangement associated with end portion 55 for matching to the impedance of an electrical connector at the lower end of the FIG. 2A pattern (e.g., a small 50 ohm connector). The theory and operation of a single omni-directive antenna of this general type are described in an article by Harold A. Wheeler titled "A Vertical Antenna Made of Transposed Sections of Coaxial Cable" as appearing in the Institute of Radio Engineers (IRE) Convention Record, Volume 4, Part 1, 1956. As explained therein, with each transmission line section having an effective length of one-half wavelength, differentials across the gaps between the successive reversed line sections results in all gaps being excited and radiating with the same polarity. Various forms of the basic Wheeler coaxial cable antenna are in commercial use and specific variations are described in U.S. patents such as U.S. Pat. Nos. 5,363,115-Lipkin et al., 5,339,089-Dienes and 5,285,211-Herper et al. The present invention utilizes new forms of this general type of coaxial line antenna in antennas comprised of new combinations of antenna elements arranged to provide improved characteristics suitable for use in multi-beam low wind resistance antennas for cellular and other applications.

In the FIG. 1 antenna each of radiators 11*a*, 12*a*, 13*a* and 14*a* comprises an identical configuration as described with reference to FIG. 2. Each of radiators 11*b*, 12*b*, 13*b* and 14*b* similarly comprise the configuration of FIG. 2 positioned upside down and arranged for upper end excitation feed from the beam forming network. As already noted the beam forming network may be configured with four antenna element feed ports which are coupled via baluns so that each such port provides two opposite phase connection points for coupling to the upper and lower radiators of a single radiating unit (i.e., radiators 11*a* and 11*b*).

Figure 3A:
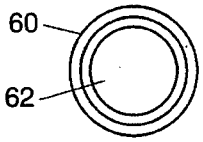
FIG. 3 shows elements of a tuned reflector unit used in the FIG. 1 antenna and FIG. 3A is a top view of such a tuned reflector unit.
Figure 3:
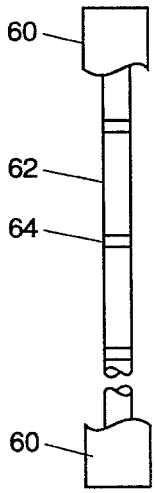

FIGS. 3 and 3A illustrate features of one of the cylindrical tuned reflector units 22, seven of which are included in the upper portion of the FIG. 1 antenna and an additional seven of which are included in the lower portion. The tuned reflector unit 22 of FIG. 3 is configured for use in the upper portion of the antenna and, when positioned upside down, for use also in the lower portion of the receiver. As shown in FIG. 3, tuned reflector unit 22 includes a cylindrical tube 60 of radiation transmissive material such as fiberglass. The middle portion of tube 60 has been removed to make visible a stack of cylindrical elements including conductive segments 62 and insulative discs 64. As shown in the enlarged end view of FIG. 3A, the cylindrical elements 62 and 64 may be of slightly smaller diameter than the inner diameter of tube 60 to enable elements 62 and 64 to be inserted into tube 60 in unconnected stacked relationship and thereafter be restricted in lateral movement by tube 40. In a preferred embodiment a spring device is positioned within tube 40 at the top end in FIG. 3 to maintain the stacked elements in the desired vertical alignment. It will be appreciated that while particular arrangements of circular cross-section have been shown in FIGS. 2B and 3A, in other embodiments it may be advantageous to employ oval, octagonal or other cross-sectional shapes. It will be understood that the metal support members 28 have reflective characteristics which are taken into consideration in design of the reflector configuration comprising the tuned reflector units 22 and the end-positioned members 28.

In the tuned reflector units 22 utilized in the FIG. 1 antenna each conductive segment 62 had the form of a section of aluminum rod less than one-half wavelength long. The aluminum rod sections were isolated from each other by relatively thin dielectric discs 64. The use of tuned reflector units of this general type is described in U.S. Pat. No. 3,836,977, issued in September 1974 to Harold A. Wheeler and assigned to the assignee of the present invention. As described therein, the length of the conductive sections is specified, taking into account capacitive effects of the gaps, so that the conductive segments will be resonant at a selected frequency. The result is that in the presence of an electromagnetic field the currents in the resonant sections will be substantially greater than in a continuous conductor. The reflector units thus produce a reflective effect relative to an incident wave which is greater than a continuous conductor. This patent also refers to description of a reflective surface formed of tuned reflective elements provided in an earlier paper authored by the patentee. The present invention utilizes an arrangement of tuned reflector units in antennas comprised of new combinations of antenna elements arranged to provide improved characteristics suitable for use in multi-beam low wind resistance antennas for cellular and other applications.

Figure 4A:
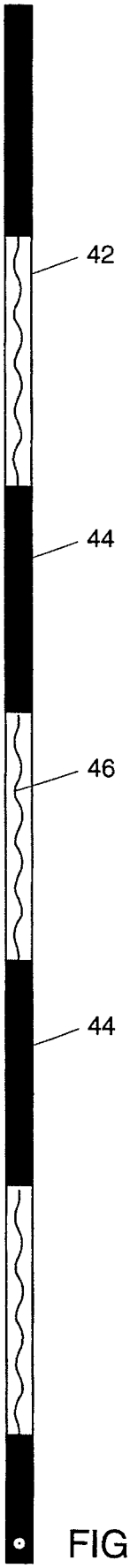
FIGS. 4A and 4B are back and front views of an embodiment of the conductive pattern bearing substrate of FIG. 2.
Figure 4B:
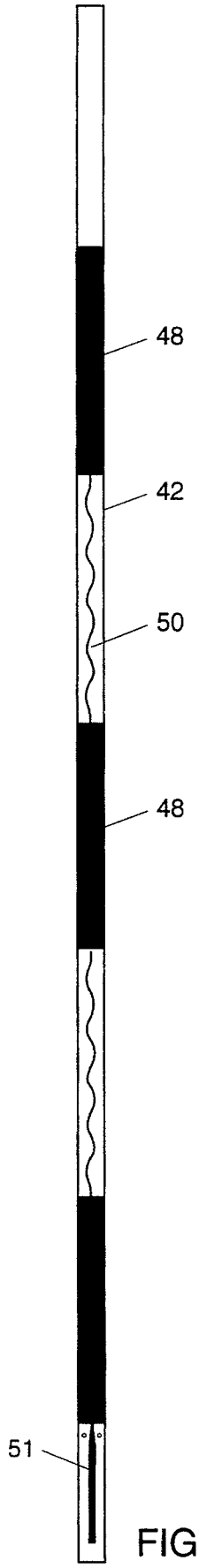

With reference to FIGS. 4A and 4B there are shown in reduced size to approximate scale the back and front sides of substrate 42 as used in an embodiment of the FIG. 1 antenna. Sections 44 and lines 46 in FIG. 4A and sections 48 and 50 in FIG. 4B (corresponding to the like-numbered items in FIGS. 2 and 2A) were formed as etched conductive patterns on the opposite sides of substrate 42. The wave pattern of lines 46 and 50, as shown, was employed to achieve the desired effective electrical line length of one-half wavelength of the microstrip line sections while providing the desired relative vertical spacing between successive line sections. The FIG. 4B pattern included an impedance transformation pattern represented at 51 to achieve satisfactory transition to an electrical connector for signal feed. Various forms of transmission line sections and cable coupling arrangements can be provided by skilled persons as suitable for different applications.

Figure 5:
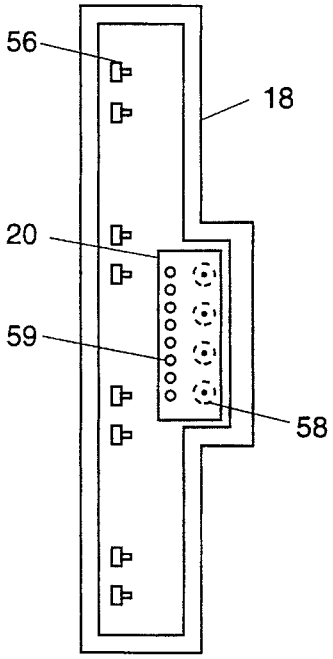
FIG. 5 is an opened view of the intermediate housing of the FIG. 1 antenna.

FIG. 5 illustrates certain features of the intermediate housing 18 of the FIG. 1 antenna, which is a structural element of the antenna and also houses and provides for signal distribution to and from the beam forming network 20. In FIG. 5 a Butler type of beam forming network is represented at 20 mounted within the lower portion of housing 18 with the upper portion of housing 18 removed. Shown dotted at 58 is one of four N-type connectors mounted below the network 20 for connection to four coaxial cables, one for accessing each of four beams of the antenna. Represented at 56 is one of eight connection points for access to input/output connectors of the eight radiators 11*a*–14*a* and 11*b*–14*b* which will be positioned at the points 56 when the antenna is assembled. The arrangement further includes (not shown) a feed line in the form of a section of coaxial cable for connecting each of the eight radiator connection points 56 to one of the eight radiator feed connections 59 represented on the beam forming network 20. Operationally, in the illustrated embodiment the Butler network 20 was configured to operatively combine signals from the four laterally spaced radiating units to form four beams. As already noted, although the beam forming network has eight antenna ports 59, such ports are used in identical signal/opposite polarity pairs to feed the upper and lower radiators of each respective radiating unit, such as unit 11*a*/11*b*. The antenna thereby operates with four beams with respective beam centers at 15 and 45 degrees left of boresight and 15 and 45 degrees right of boresight, in order to provide coverage in a 120 degree sector.

Figure 6:
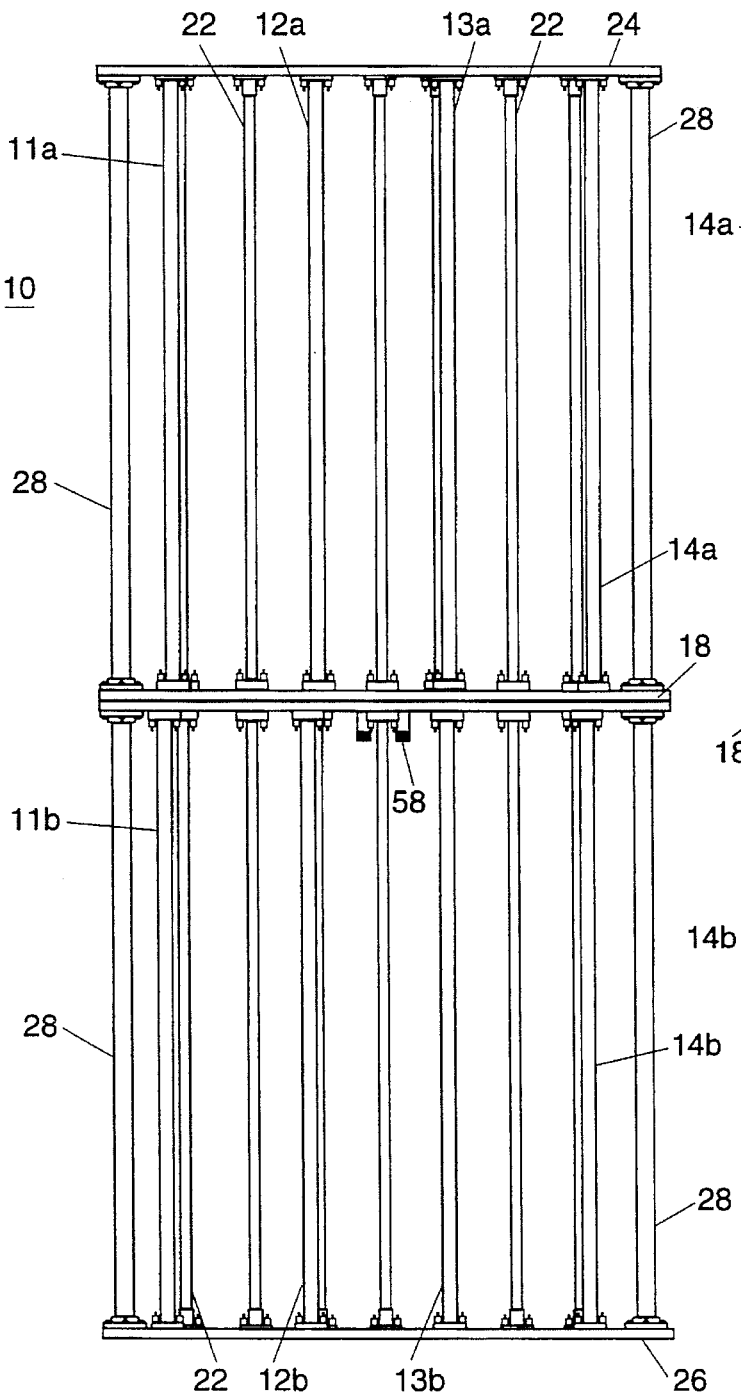
FIGS. 6 and 6A are front and side views of an embodiment of the FIG. 1 antenna.
Figure 6A:
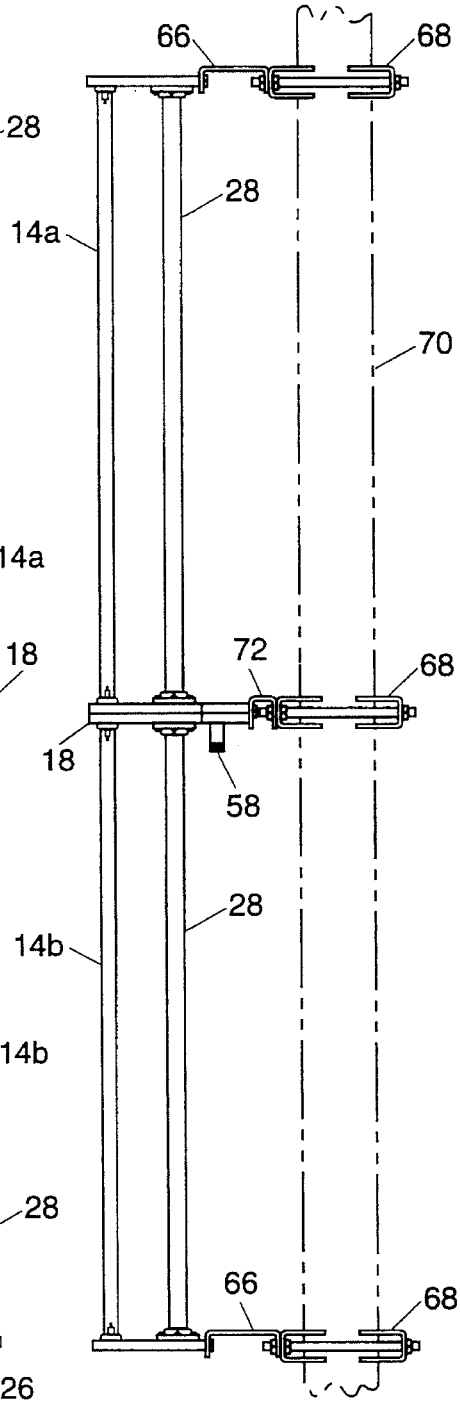

FIGS. 6 and 6A are front and side views showing additional construction details of a FIG. 1 type multi-beam, low wind resistance antenna adapted for pole or tower mounting in cellular type applications. This antenna had overall width and height dimensions of approximately 30 by 66 inches and was designed for use at frequencies in a band between 800 and 850 MHz. Each radiator, such as radiator 11*a*, had an outside diameter of three-quarters of an inch and substrate 42 had a length and width of approximately 33 by 0.6 inches. Diameters of tuned reflector units 22 and the aluminum structural support tubes 28 were respectively one-half inch and one inch. The aluminum rod sections 62 had a typical diameter and length of approximately 0.25 by 6 inches and the dielectric discs 64 were of the same diameter and about 0.2 inches thick. Adjacent radiators such as 11*a* and 12*a* were spaced by approximately 7.5 inches and adjacent tuned reflector units were spaced by approximately 3.5 inches, or about one-quarter wavelength. As shown, a fastening fixture was provided at each end of each of the radiators (11*a*, for example), tuned reflector units 22 and support tubes 28 to permit fastening to respective points on the upper and lower structural units 24 and 26 and intermediate housing 18. Thus, during antenna assembly the various vertical elements in this embodiment are bolted or screwed to the transverse structural elements 18, 24 and 26 to provide a sturdy structure having low wind resistance and typically capable of withstanding winds up to 125 miles per hour when mounted on an exposed position on a tower, for example. FIG. 6A, in addition to showing the relationship of the row of radiators aligned in front of the row of support tubes 28 and tuned reflector elements 22 (obscured by tube 28), also illustrates pole mounting of the antenna. Thus, as shown, upper and lower extension brackets 66 support known types of pole clamping devices 68 (particular forms of brackets 30 of FIG. 1), which are bolted in place around pole 70. The middle extension bracket 72 supports a similar clamping device from the rear of the housing 18. Housing 18, which encloses the beam forming network 20 as shown in FIG. 5, also provides a rear accessible location for connection of coaxial antenna feed cables to the downward oriented beam access connectors 58. As visible in FIG. 6, in this embodiment the upper radiators are each offset slightly from their paired lower radiators. This offset of each lower radiator to the left of its upper radiator in FIG. 6 is for mechanical purposes of enabling easier connections to the radiator conductive patterns from within the housing 18 and has very little effect on antenna performance.

Figure 7A:
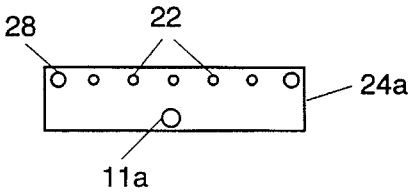
FIGS. 7 and 7A are front and plan views of a single beam low wind resistance antenna in accordance with the invention.
Figure 7:
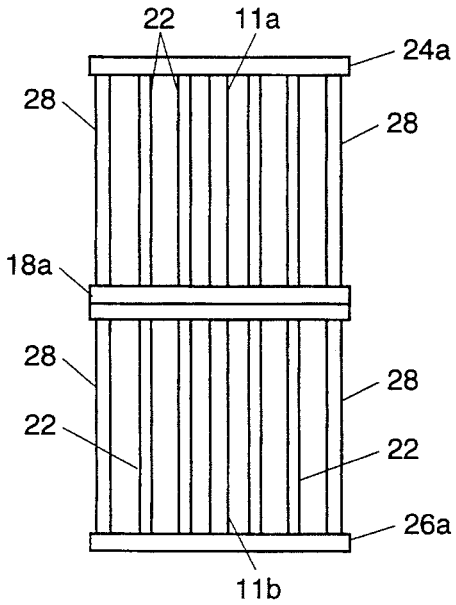

FIGS. 7 and 7A illustrate application of the invention to an antenna including only one radiating unit 11*a*/11*b*. In this example support tubes 28 and tuned reflector units 22 are provided, as in the FIG. 1 antenna, with the horizontal reflector width of the tuned reflector/support tube assembly determined by the particular azimuth beamwidth requirements. Intermediate housing 18*a* is arranged to enable coupling a single external antenna feed cable to a balun connected to the upper and lower radiators 11*a* and 11*b*, there being no need for inclusion of a beam forming network. In this type of configuration the invention permits use of a larger reflector assembly for greater antenna gain/decreased backlobe response without resulting in unacceptable wind loading in tower or pole type mounting. As shown by top view in FIG. 7A, upper and lower structural units 24*a* and 26*a* are similar but narrower than units 24 and 26 of the FIG. 1 antenna. In other applications it may be appropriate to provide an antenna as in FIG. 1 but omitting the lower elements 11*b*–14*b*, 22, 28 and 26 to provide a multi-beam capability with about twice the vertical beamwidth. Alternatively, an antenna of the FIG. 1 type can be configured with upper and lower radiators (e.g., 11*a* and 11*b*) replaced by double length radiators fed by a beam forming network positioned at the bottom within unit 26. Such a modified antenna would exhibit similar beam focusing capabilities, however, signal attenuation within the antenna would be approximately doubled and the operating frequency band width of the antenna would be about one-half as compared to the FIG. 1 antenna. It will also be appreciated that the conductive patterns on substrate 42 and other antenna components can be provided in different shapes and configurations by skilled persons once having an understanding of the invention. For example, the alternating nominally one-half wavelength transmission line sections of the radiators may be provided in many different forms which may not utilize conductive patterns on a substrate.

While there have been described the currently preferred embodiments of the invention, those skilled in the art will recognize that other and further modifications may be made without departing from the invention and it is intended to claim all modifications and variations as fall within the scope of the invention.

What is claimed is:

1. An antenna with thin cylindrical radiating and reflector units for low wind resistance, comprising:

a plurality of cylindrical radiating units laterally spaced relative to a forward direction and each having upper and lower radiators, said radiators each including a linear series of nominally one-half wavelength transmission line sections extending in a vertical direction with gaps between said sections and arranged to be fed in series from one end;

said upper and lower radiators of each radiating unit respectively positioned above and below an intermediate level with each said upper radiator configured for lower end excitation feed and each said lower radiator configured for upper end excitation feed;

a beam forming network coupled to said lower end of the upper radiator of each said radiating unit and to said upper end of the lower radiator of each said radiating unit to provide a predetermined multi-beam pattern;

a plurality of laterally spaced cylindrical tuned reflector units positioned behind said radiating units, each said tuned reflector unit including a plurality of conductive segments extending in electrically isolated end-to-end relationship in a vertical direction; and a support assembly configured to support said radiating units in laterally spaced arrangement and said tuned reflector units in laterally spaced arrangement behind said radiating units.

2. An antenna as in claim 1, wherein said transmission line sections of each said radiator comprise microstrip line sections formed of conductive patterns on two opposed sides of a planar insulative substrate and each said radiator additionally includes a cylindrical radome enclosing said substrate.

3. An antenna as in claim 2, wherein said cylindrical radome is a tube of circular cross-section with an outside diameter of nominally 0.75 inches and said substrate has a width of nominally 0.6 inches.

4. An antenna as in claim 2, wherein each said conductive segment of each said tuned reflector unit is a segment of conductive rod isolated from adjacent segments by intermediate insulative discs, the combination configured to be resonant at a selected frequency, and each said tuned reflector unit additionally includes a cylindrical radome enclosing said rod segments and discs.

5. An antenna as in claim 1, including a laterally spaced plurality of only four said radiating units and wherein said beam forming network is configured to provide four beams.

6. An antenna as in claim 5, including a laterally spaced plurality of only seven upper and seven lower of said tuned reflector units.

7. An antenna as in claim 1, wherein said beam forming network provides dual polarity outputs via balun connections providing a first polarity connection to each said upper radiator and a respective opposite polarity connection to each said lower radiator.

8. An antenna with thin cylindrical radiating and reflector units for low wind resistance, comprising:

a plurality of cylindrical radiating units laterally spaced relative to a forward direction and each having upper and lower radiators, said radiators each including a linear series of nominally one-half wavelength transmission line sections extending in a vertical direction with gaps between said sections and arranged to be fed in series from one end;

said upper and lower radiators of each radiating unit respectively positioned above and below an intermediate level with each said upper radiator configured for lower end excitation feed and each said lower radiator configured for upper end excitation feed;

a beam forming network coupled to said lower end of the upper radiator of each said radiating unit and to said upper end of the lower radiator of each said radiating unit to provide a predetermined beam pattern;

a plurality of laterally spaced cylindrical tuned reflector units positioned behind said radiating units, each said tuned reflector unit including a plurality of conductive segments extending in electrically isolated end-to-end relationship in a vertical direction and wherein each said conductive segment of each said tuned reflector unit is a segment of conductive rod isolated from adjacent segments by intermediate insulative discs, the combination configured to be resonant at a selected frequency, and each said tuned reflector unit additionally includes a cylindrical radome enclosing said rod segments and discs; and a support assembly configured to support said radiating units in laterally spaced arrangement and said tuned reflector units in laterally spaced arrangement behind said radiating units.

9. An antenna as in claim 8, wherein said cylindrical radome is a tube of circular cross-section with an outside diameter of nominally 0.5 inches and said rod segments and discs are of circular cross-section with outside diameters of nominally 0.25 inches.

10. An antenna with thin cylindrical radiating and reflector units for low wind resistance, comprising:

a plurality of cylindrical radiating units laterally spaced relative to a forward direction and each having upper and lower radiators, said radiators each including a linear series of nominally one-half wavelength transmission line sections extending in a vertical direction with gaps between said sections and arranged to be fed in series from one end;

said upper and lower radiators of each radiating unit respectively positioned above and below an intermediate level with each said upper radiator configured for lower end excitation feed and each said lower radiator configured for Upper end excitation feed;

a beam forming network coupled to said lower end of the upper radiator of each said radiating unit and to said upper end of the lower radiator of each said radiating unit to provide a predetermined beam pattern;

a plurality of laterally spaced cylindrical tuned reflector units positioned behind said radiating units, each said tuned reflector unit including a plurality of conductive segments extending in electrically isolated end-to-end relationship in a vertical direction; and a support assembly configured to support said radiating units in laterally spaced arrangement and said tuned reflector units in laterally spaced arrangement behind said radiating units, said support assembly comprising an intermediate housing coupled to the lower end of each upper radiator, the upper end of each lower radiator and one end of each tuned reflector unit and configured to enclose said beam forming network.

11. An antenna as in claim 10, wherein said support assembly additionally comprises upper and lower transverse structural units coupled to the respective upper and lower ends of each radiator and tuned reflector unit distal from said intermediate housing, and additional cylindrical support members connected between said intermediate housing and said upper and lower transverse structural units.

12. An antenna with thin cylindrical radiating and reflector units for low wind resistance, comprising:

a plurality of cylindrical radiators laterally spaced relative to a forward radiation direction, each said radiator including a linear series of nominally one-half wavelength transmission line sections extending in a vertical direction with gaps between said sections and arranged to be fed in series from one end;

a beam forming network coupled to said one end of each said radiator to provide a predetermined multi-beam radiation pattern;

a plurality of laterally spaced cylindrical tuned reflector units positioned behind said radiators, each said tuned reflector unit including a plurality of conductive segments extending in electrically isolated end-to-end relationship in a vertical direction; and a support assembly configured to support said radiators in lateral spaced arrangement and said tuned reflector units in laterally spaced arrangement behind said radiating units.

13. An antenna as in claim 12, wherein said transmission line sections of each said radiator comprise microstrip line sections formed of conductive patterns on two opposed sides of a planar insulative substrate and each said radiator additionally includes a cylindrical radome enclosing said substrate.

14. An antenna as in claim 13, wherein each said conductive segment of each said tuned reflector unit is a segment of conductive rod isolated from adjacent segments by intermediate insulative discs, the combination configured to be resonant at a selected frequency, and each said tuned reflector unit additionally includes a cylindrical radome enclosing said rod segments and discs.

15. An antenna as in claim 12, including a laterally spaced plurality of only four said radiators and wherein said beam forming network is configured to provide four beams.

16. An antenna as in claim 15, including a laterally spaced plurality of only seven said tuned reflector units.

17. An antenna as in claim 12, wherein each said conductive segment of each said tuned reflector unit is a segment of conductive rod isolated from adjacent segments by intermediate insulative discs, the combination configured to be resonant at a selected frequency, and each said tuned reflector unit additionally includes a cylindrical radome enclosing said rod segments and discs.

18. An antenna with thin cylindrical radiating and reflector units for low wind resistance, comprising:

a cylindrical radiating unit having an upper and a lower radiator each including a linear series of nominally one-half wavelength transmission line sections extending in a vertical direction with gaps between said sections and arranged to be fed in series from one end;

said upper and lower radiators of said radiating unit respectively positioned above and below an intermediate level with said upper radiator configured for lower end excitation feed and said lower radiator configured for upper end excitation feed;

a plurality of laterally spaced cylindrical tuned reflector units spaced from said radiating unit, each said tuned reflector unit including a plurality of conductive segments extending in electrically isolated end-to-end relationship in a vertical direction; and a support assembly configured to support said tuned reflector units in positions spaced from each other and from said radiating unit.

19. An antenna as in claim 18, wherein said transmission line sections of said radiator comprise microstrip line sections formed of conductive patterns on two opposed sides of a planar insulative substrate and said radiator additionally includes a cylindrical radome enclosing said substrate.

20. An antenna as in claim 18, wherein each said conductive segment of each said tuned reflector unit is a segment of conductive rod isolated from adjacent segments by intermediate insulative discs, the combination configured to be resonant at a selected frequency, and each said tuned reflector unit additionally includes a cylindrical radome enclosing said rod segments and discs.

21. An antenna with thin cylindrical radiating and reflector units for low wind resistance, comprising:

a cylindrical radiating unit having an upper and a lower radiator each including a linear series of nominally one-half wavelength transmission line sections extending in a vertical direction with gaps between said sections and arranged to be fed in series from one end;

said upper and lower radiators of said radiating unit respectively positioned above and below an intermediate level with said upper radiator configured for lower end excitation feed and said lower radiator configured for upper end excitation feed;

a plurality of laterally spaced cylindrical tuned reflector units spaced from said radiating unit, each said tuned reflector unit including a plurality of conductive segments extending in electrically isolated end-to-end relationship in a vertical direction; and a support assembly configured to support said tuned reflector units in positions spaced from each other and from said radiating unit, and wherein said support assembly comprises an intermediate housing coupled to the lower end of said upper radiator, the upper end of said lower radiator and one end of each tuned reflector unit and configured to enable said excitation feeds to said radiators.

22. An antenna as in claim 21, wherein said support assembly additionally comprises upper and lower transverse structural units coupled to the respective upper and lower ends of each radiator and tuned reflector unit distal from said intermediate housing, and additional cylindrical support members connected between said intermediate housing and said upper and lower transverse structural units.

23. An antenna with thin cylindrical radiating and reflector units for low wind resistance, comprising:

a plurality of cylindrical radiating units laterally spaced relative to a forward direction and each having upper and lower radiators, said radiators (a) each including a linear series of nominally one-half wavelength transmission line sections extending in a vertical direction with gaps between said sections and arranged to be fed in series from one end, and (b) each having the form of microstrip line sections on an insulative substrate enclosed within a cylindrical radome;

said upper and lower radiators of each radiating unit respectively positioned above and below an intermediate level with each said upper radiator configured for lower end excitation feed and each said lower radiator configured for upper end excitation feed;

a beam forming network coupled to said lower end of the upper radiator of each said radiating unit and to said upper end of the lower radiator of each said radiating unit to provide a predetermined beam pattern, said network configured to provide dual polarity outputs via balun connections providing a first polarity connection to each said upper radiator and a respective opposite polarity connection to each said lower radiator;

a plurality of laterally spaced cylindrical tuned reflector units positioned behind said radiating units, each said tuned reflector unit (a) including a plurality of conductive segments extending in electrically isolated end-to-end relationship in a vertical direction, and (b) having the form of segments of conductive rod isolated by intermediate insulative discs and enclosed within a cylindrical radome; and a support assembly configured to support said radiating units in laterally spaced arrangement and said tuned reflector units in laterally spaced arrangement behind said radiating units.

* * * * *